US005209474A

United States Patent [19]

Voyer

[11] Patent Number: 5,209,474

[45] Date of Patent: May 11, 1993

[54] ELONGATED GOLF PUTTER AND PUTTING METHOD

[75] Inventor: Paul J. Voyer, Greenville, S.C.

[73] Assignee: VH Golf, Inc., Greenville, S.C.

[21] Appl. No.: 878,055

[22] Filed: May 4, 1992

[51] Int. Cl.[5] ..... A63B 53/02

[52] U.S. Cl. ..... 273/80 C; 273/167 G; 273/80.2

[58] Field of Search ..... 273/77 B, 80 C, 80.2, 273/80.3, 80.4, 80.5, 80.6, 80.7, 80.8, 81 R, 167 G

[56] References Cited

U.S. PATENT DOCUMENTS

| | | | |
|---|---|---|---|
| 3,188,086 | 6/1965 | Parmley | 273/81.3 |
| 4,138,117 | 2/1979 | Dalton | 273/80 C |
| 4,163,554 | 8/1979 | Bernhardt | 273/80 C |
| 4,411,429 | 10/1983 | Drew et al. | 273/80 C X |
| 4,592,552 | 6/1986 | Garber | 273/80 C Y |
| 5,058,895 | 10/1991 | Igarashi | 273/167 F |
| 5,078,398 | 1/1992 | Reed et al. | 273/167 G |
| 5,133,555 | 6/1992 | Bailey | 273/80 C X |

OTHER PUBLICATIONS

"Golf World", Stretch article, Jun. 1964, p. 4.

"Golf Digest", Bill Viele and His Long Putter, Jan. 1979, pp. 23, 24.

"Golf Digest", Feb. 1988, p. 111.

"Golf", On the Putting Edge, Mar. 1992, pp. 108-111.

*Primary Examiner*—William H. Grieb

*Assistant Examiner*—William M. Pierce

*Attorney, Agent, or Firm*—Leatherwood Walker Todd & Mann

[57] ABSTRACT

A golf putter having an elongated shaft defining a medial stabilization portion and an upper stabilization portion. During putting, the medial stabilization portion is received in the crook of a golfer's arm, and the upper stabilization portion contacts the outer surfaces of the golfer's upper arm. A club head is attached to an end of the elongated shaft by an offset connector, which offsets the club head laterally from the end of the elongated shaft. The offset connector also disposes the elongated shaft both at an angle towards a putting face defined in the club head and at an angle towards the heel of the club head. A method of putting using the putter constructed in accordance with the present invention is also disclosed, wherein the elongated shaft is held in a generally conventional putting grip while the medial stabilization portion is received in the crook of the golfer's arm, and while the upper stabilization portion contacts the outer portion of the upper arm. By putting in such a method using the elongated putter, the golfer's wrists and leading arm are restrained from flexing and bending, thereby allowing for improved putting consistency.

16 Claims, 4 Drawing Sheets

ELONGATED GOLF PUTTER AND PUTTING METHOD

BACKGROUND OF THE INVENTION

This invention relates generally to a golf putter with an elongated shaft and a method of using the putter.

There are a variety of styles and configurations of golf clubs available on the market within the specialized class of golf clubs known as "putters." Briefly, golf putters are specially designed for use in putting a golf ball along substantially smooth grass portions of a golf course, known as "putting greens." Because the object of a golf game is to complete the golf course with as few golf club strokes as possible, and because putting often accounts for nearly half of the golfer's total strokes over an average golf course, putters are of particular importance to dedicated golfers.

When putting, the golfer is attempting to keep the ball on the ground during its travel towards the hole. A vast majority of putts are of a relatively short distance, requiring directional accuracy as a priority, with the force delivered to the ball generally being less than would be desired when using regular golf clubs.

In an attempt to provide the golfer with greater accuracy in putting, elongated putters have been developed. Typically, with such elongated putters, the golfer would place his left hand at the top of the putter's shaft and the golfer's right hand would be placed approximately midway along the putter's shaft to allow the putter to pivot about the left hand, which acts as a pivot point, during a putting swing. Such a putter is described in the February 1988 issue of *Golf Digest* (page 111).

Another elongated putter was discussed in the January 1979 issue of *Golf Digest* (pages 23–24), wherein the upper end of the putter's shaft is inserted in the golfer's left armpit. Standing more upright than is normal for putting in a seemingly awkward position, the golfer then grasps the shaft with both hands during a putting stroke. The grip used in grasping the putter is generally unlike the grip conventionally used during putting. Further, because the putter is inserted in the golfer's armpit, the length of the shaft could be critical in determining the comfort and usability of the putter for a golfer of a particular height, putting style, etc.

Still another elongated shaft is discussed in the Jun. 19, 1964 issue of *Golf World* (page 4). When using that putter, the golfer bends over in a rather awkward position such that his back is substantially parallel to the ground. He anchors with his left hand the upper portion of the putter's shaft on his right shoulder, near his neck. The golfer's right hand then grasps the lower portion of the putter's shaft to make a putting stroke.

U.S. Pat. Nos. 3,188,086 issued to Parmley on Jun. 8, 1965, and 4,163,554 issued to Bernhardt on Aug. 7, 1979, both disclose elongated putters. In the Parmley patent, the upper end of the putter's shaft is pressed against the golfer's abdomen and pivots with respect to the abdomen during the putting stroke. In the Bernhardt patent, an elongated putter is disclosed which is used to putt a golf ball in a modified croquet style, i.e., with the golfer facing the hole and swinging the club in an arc spanning substantially parallel to his side during putting. A disadvantage of croquet style putters has been that their use is limited by United States Golf Association (hereinafter "USGA") rules, which require that a golfer have both feet on one side of the line which extends through the ball and the cup. This rule necessarily prohibits swinging a croquet style putter in true croquet form, wherein the putter would be swung between the golfer's legs, because such would normally require the golfer to straddle the line connecting the ball and cup.

A common problem among golfers during putting is that the golfer may bend or "break" his wrists during putting. This can cause loss of directional and speed control of the ball during putting, resulting in poor speed and/or direction, and in its most extreme form, a phenomena commonly known as the "yips."

One attempt to hold steady the left wrist during putting, thereby preventing the left wrist from flexing, has been the development of a modified gripping of the club wherein the bottom of the grip is held with the left hand, and the right hand is separated from the left hand and holds the shaft against the left forearm. This type of modified grip has been used by professional golfer Bernhard Langer, and is described in the March 1992 issue of *Golf Magazine* (page 108). Disadvantages of the modified grip are that when using a conventional putter, the golfer is forced to bend over more than would be necessary if using a traditional grip and that the same "feel" does not exist that many golfers attribute to the more traditional two handed grip. This lack of "feel" is often a source of criticism of existing elongated putters.

From the foregoing, it is evident that problems exist with a variety of attempts to improve a golfer's putting. Accordingly, the golf putter and putting method of the present invention is directed to overcoming one or more of the problems as set forth above.

SUMMARY OF THE INVENTION

It is a principal object of this invention to reduce the difficulty of putting accurately.

Another object of the present invention is to provide a golf putter which allows the golfer to grip the putter in a conventional manner.

Another object of the present invention is to provide a golf putter which restrains bending of the golfer's wrists and leading arm during putting.

Another object of the present invention is to provide a method for more accurately putting a golf ball.

A further object of the present invention is to provide a golf putter that would be suitable for use by a wide variety of golfers.

Still another object of the present invention is to provide a golf putter which conforms with the regulations of the United States Golf Association.

Yet another object of the present invention is to provide a method for more accurately putting a golf ball which can be practiced by a wide variety of golfers.

Generally, the present invention includes a golf club for use by a golfer to putt a golf ball, comprising an elongated shaft defining a first end, a second end opposite the first end, a medial stabilization portion, and an upper stabilization portion spaced from the medial stabilization portion.

The golf club includes a club head having a substantially planar putting face, a rear face opposite the putting face, an upper surface, and a lower surface opposite the upper surface. The club head defines a central axis approximately midway between the putting face and the rear face, and extends substantially parallel to the putting face.

An offset connector is connected to the club head and to the first end of the elongated shaft. The offset connector offsets the first end of the elongated shaft from the central axis of the club head in a direction towards the rear face of the club head, such that when using the golf club for putting, the medial stabilization portion of the elongated shaft is received in the crook of the golfer's arm, and the upper stabilization portion of the elongated club contacts the outer portion of the golfer's upper arm to restrain movement of the golf club relative to the golfer's arms and wrists during putting.

More specifically, the putting face of the club head has a substantially planar surface portion extending at an acute angle with respect to the lower surface of the club head.

Further, the present invention provides a method for putting a golf ball by a golfer, comprising providing a golf club having a club head and an elongated shaft connected thereto defining a medial stabilization portion and an upper stabilization portion.

The method also includes positioning the golf putter such that the medial stabilization portion is received in the crook of the golfer's arm and such that the upper stabilization portion contacts the outer portion of the golfer's upper arm. Moreover, the method includes gripping of the elongated shaft by the golfer's hands and moving of the golfer's arms while retaining the medial stabilization portion in the crook of the arm and the upper stabilization portion against the outer portion of the golfer's upper arm, such that the club head of the golf putter contacts the golf ball in accomplishing a putt.

DESCRIPTION OF THE PREFERRED EMBODIMENT

Figure 1:
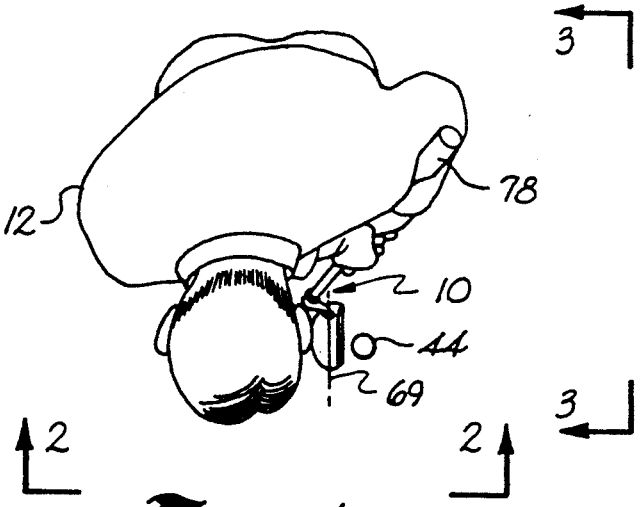
FIG. 1 is a plan view of a golf club constructed in accordance with the present invention being held by a golfer.

Referring to the drawings in detail, wherein like reference characters represent like elements or features throughout the various views, the elongated golf putter of the present invention is designated generally in the figures by the reference character 10. Although a male golfer is illustrated in the figures and is referred to in the description for simplicity, it is to be understood that the present invention could be used by males and females alike.

Figure 2:
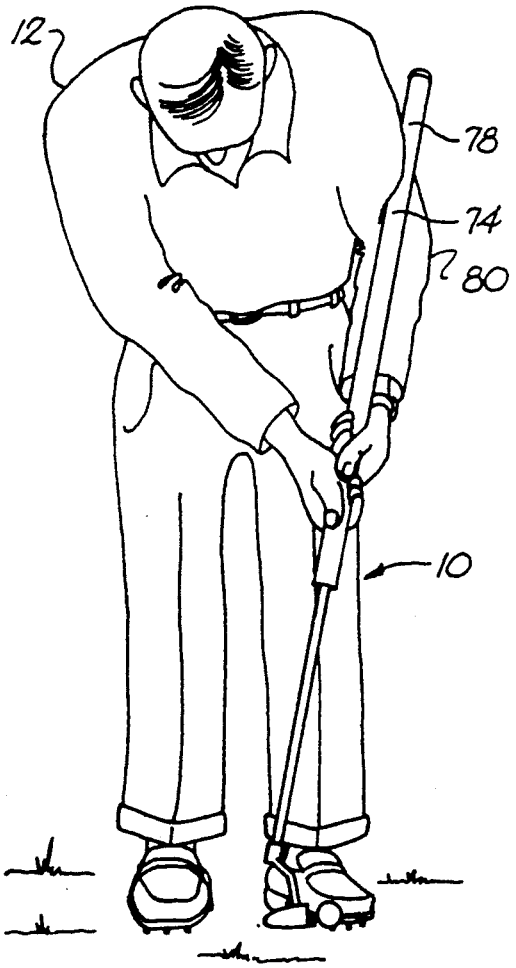
FIG. 2 is an elevational view of a golfer using a golf club constructed in accordance with the present invention taken along lines 2—2 of FIG. 1.
Figure 3:
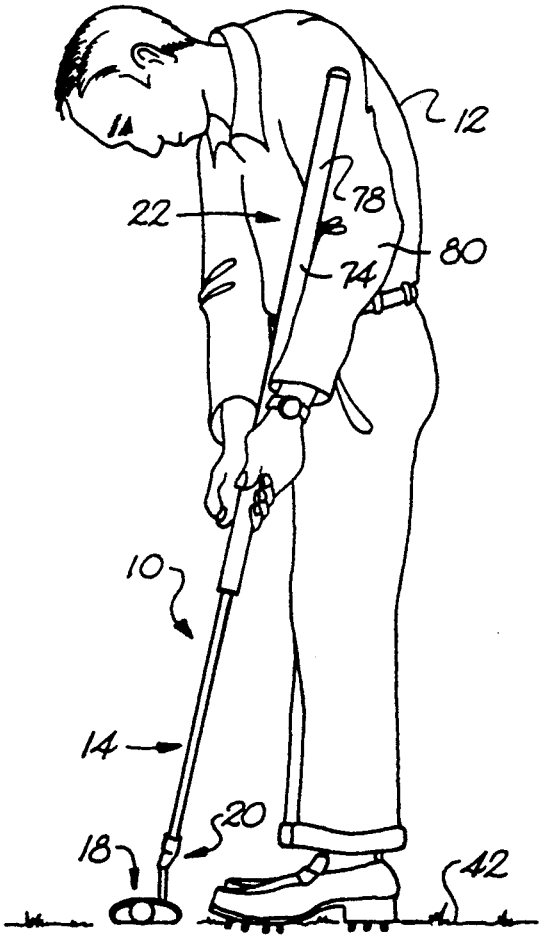
FIG. 3 is a side elevational view of a golfer using a golf club constructed in accordance with the present invention taken along lines 3—3 of FIG. 1.

Referring to FIGS. 1-3, golf club or putter 10 is shown being held by a golfer 12 in a putting stance. Golf club 10 includes elongated shaft, generally 14, a club head, generally 18, having a hosel, or connector, generally 20, and a grip, generally 22.

Elongated shaft 14 is preferably constructed of metal or composite material such that the straightness, bending and twisting properties are in conformance with the United States Golf Association (hereinafter "USGA") requirements for golf club design. A conventional tubular steel shaft may also be used to construct elongated shaft 14. While conventional putters generally range in length from 33 to 37 inches, the length of the elongated shaft 14, when combined with the height of club head 18 and hosel 20, would generally exceed 37 inches, and in one preferred embodiment, yields a putter 10 having a length of approximately 49 inches. The length of elongated shaft 14 can depend in part on the golfer's height and preference for knee flex during putting. However, as discussed in more detail below, the length of elongated shaft 14 should be such that the upper end of shaft 14 extends at least far enough to contact the outer arm portions of the golfer's leading arm during putting.

Although not shown, elongated shaft 14 could be, but does not have to be, constructed of more than one readily detachable shaft sections, which could be inserted for interference fits into the ends of each other, to reduce the length of putter 10 for ease of handling, for example, during traveling.

Figure 8:
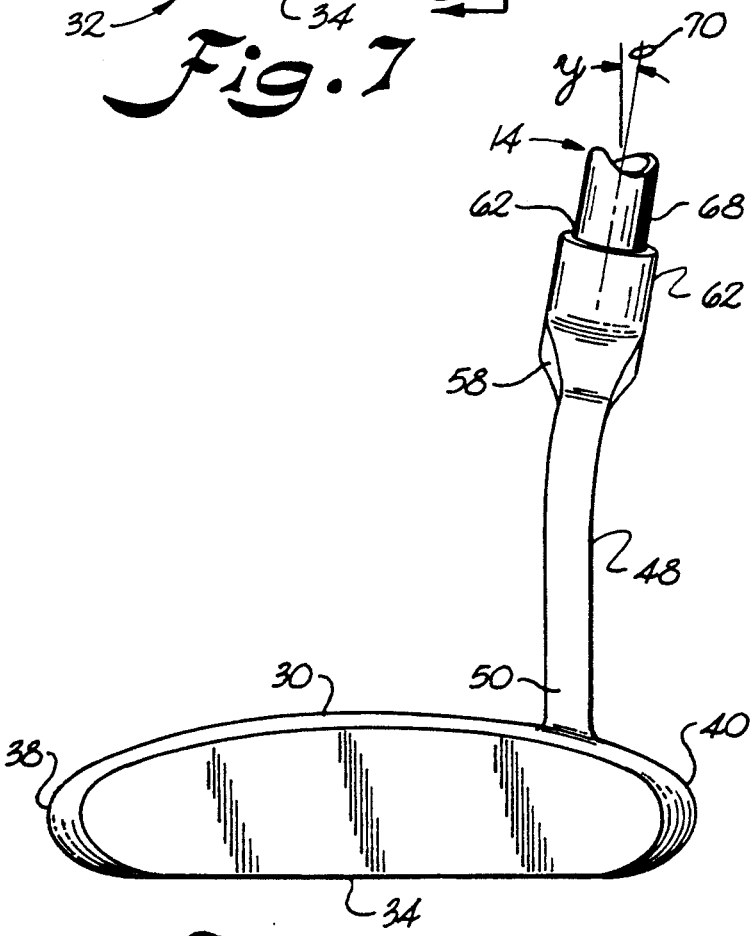
FIG. 8 is a side elevational view taken along lines 8—8 of FIG. 7.
Figure 9:
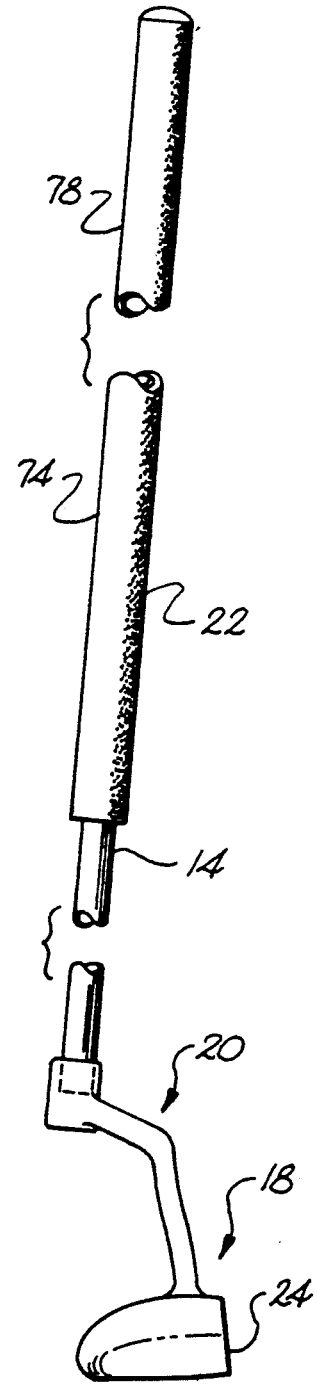
FIG. 9 is an elevational view of a putter constructed in accordance with the present invention.
Figure 10:
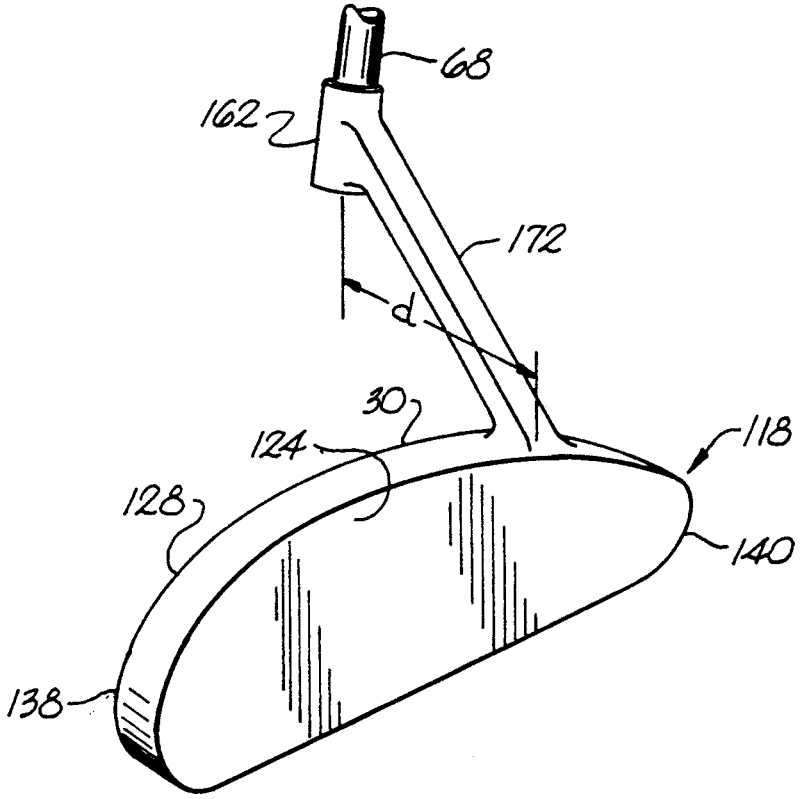
FIG. 10 is a prospective view of an alternate embodiment of a club head and hosel constructed in accordance with the present invention.

Club head 18 is of conventional design and could be either the style as shown in FIGS. 1 through 9, the blade style as shown in FIG. 10, or any of a variety of other configurations. Club head 18 could be constructed of bronze, steel, composite material, or any other material suitable for a golf club head.

Figure 7:
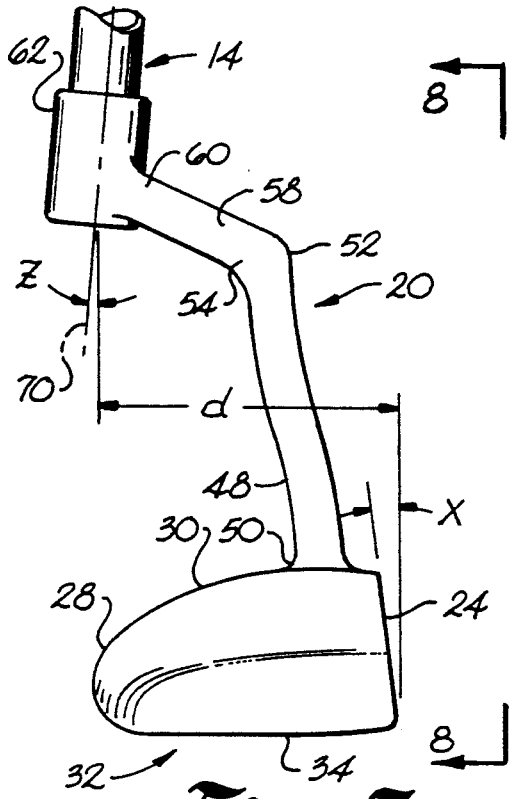
FIG. 7 is a partial elevational view of a club head and hosel constructed in accordance with the present invention.

Turning to FIGS. 7 through 9, club head 18 includes a substantially planar ball contact, or putting, face 24, and a rear face 28 spaced opposite from putting face 24. Club head 18 further includes an upper surface 30 and a lower surface, generally 32, having a planar portion 34. Additionally, club head 18 includes a toe portion 38 and a heel portion 40 opposite toe portion 38.

One feature of putter 10 includes putting face 24 being inclined with respect to lower surface 32 such that the angle between putting face 24 and lower surface 32 is less than 90 degrees, or an acute angle. Putting face 24 is inclined towards rear face 28 from a line substantially perpendicular to lower surface 32 by angle X, with angle X preferably being in the range of 5 to 15 degrees, and in one exemplary embodiment, approximately 8 degrees. However, club head 18 could be provided with a perpendicular putting face 24 or with a putting face 24 of greater than or less than 8 degrees from perpendicular.

As will be discussed in more detail later, putting face 24 is provided angle X such that when putter 10 is gripped and positioned in accordance with the method described herein by golfer 12 for putting, putting face 24 becomes substantially parallel to perpendicular with respect to the ground 42 at the point of contact with ball 44 being putted. Preferably, putting face 24 is at a slight angle between 0 and 3 degrees from perpendicular with respect to the ground at the point of contact of ball 44.

Extending upwardly from club head 18 is an offset connector 20 which connects club head 18 to elongated shaft 14. As best shown in FIGS. 7 through 9, connector 20 includes an upstanding member 48 extending upwardly from club head 18. A first end 50 of upstanding member 48 is connected to upper surface 30 of club head 18. The second end 52 of upstanding member 48 is connected to the first end 54 of an angled bridging member 58. A second end 60 of bridging member 58 is provided with a socket 62. Socket 62 includes a generally cylindrical cavity 64 for receipt of the first end of elongated shaft 14. Offset connector 20 could be constructed of bronze, steel, composite material, or any other suitable material and could also be of a variety of configurations other than those discussed and illustrated herein.

While putter 10 is illustrated in the figures as having an offset connector 20, putter 10 could also be constructed without such an offset connector, with elongated shaft 14 being connected directly to club head 18 by press fit, interference fit, threaded connection, or some other suitable fastening means. Such a connection of elongated shaft 14 to club head 18 could also be offset from the central axis 69 of club head 18, similarly as shaft 14 is offset by offset connector 20.

As shown in FIGS. 7 and 8, elongated shaft 14 defines a longitudinally extending shaft axis 70. Upstanding member 48 and angled bridging member 58 are angled and configured such that elongated shaft 14 has, when in use, an angle Y with respect to ground 42. USGA rules require that angle Y, also known as the lie angle, be at least 10 degrees. Depending on the height of the golfer, putter 10 could be provided with an elongated shaft 14 with an angle y of at least 10 degrees, and greater, if necessary.

Another significant feature of putter 10 includes first end 68 of shaft 14 being offset laterally from putting face 24 by a predetermined distance d in the direction of rear, or rearward, face 28. Preferably, first end 68 of shaft 14 is offset laterally from putting face 24 beyond the central axis 69 of club head 18, in a direction towards rear face 28. The offsetting of first end 68 of shaft 14 allows golfer to address the ball and configure his hands in a manner as would be used if putting with a conventional putter.

In addition to socket 62 being at an angle Y for fixing the lie angle of putter 10, socket 62 is also configured to provide shaft 14 with an offset angle Z. Offset angle Z, in conjunction with the lateral offset D of shaft 14 provided by connector 20, allows golfer 12 to grip putter 10 and address the ball in a generally conventional manner. Offset angle Z is preferably approximately 5 degrees from perpendicular, with respect to lower surface 34 and towards putting face 24, although a range of 2 to 8 degrees is also satisfactory. It is to be understood that offset angle Z could be any number of angles, depending on the length of shaft 14 and on the particular golfer's height, abilities and preferences.

Grip 22 is constructed of a material which is preferably of generally circular or non-circular cross-section and which is in accordance with the rules of the USGA. Grip 22 could be of any length, but preferably extends from slightly below the mid-portion of shaft 14 all the way to the end of shaft 14. Grip 22 defines a medial stabilization portion 74 for being received in the crook of the golfer's arm and an upper stabilization portion 78 for contacting the outer portions of the golfer's upper arm, or the clothing adjacent the upper arm, during putting. Medial and upper stabilization portions 74, 78 will be discussed in more detail below.

FIG. 10 shows an alternate embodiment of the club head and hosel constructed in accordance with the present invention. As shown in FIG. 10, a club head, generally 118 is provided which is of conventional design. With club head 118, putting face 124 is slightly inclined towards rearward face 128. Club head 118 includes a toe portion 138 and a heel portion 140. Hosel, generally 120, includes an angled support member 172 connected to upper surface 30 of club head 118. Angled support member 172 includes a socket 162 at the opposite end thereof which has a substantial cylindrical cavity 164 for receiving the first end 68 of shaft 14. Angled support member 172 laterally offsets shaft 14 a predetermined distance D from putting face 124. Socket 162 is provided with a lie angle Y and angles X and Z similarly as is provided with socket 162 discussed above, to thereby position shaft 14 with respect to club head 118 similarly as shaft 14 is positioned with respect to club head 14, discussed above.

In addition to disclosing an elongated putter 10, as discussed above, the present invention also includes a method of putting, which preferably entails the use of a putter such as putter 10. As can best be seen from FIGS. 1 through 6, in practicing the putting method, golfer 12 grasps grip portion 22 of putter 10 in a generally conventional putting grip. Putter 10 is then manipulated such that a medial stabilization portion 74 of putter 10 is received in the crook of the golfer's "leading" arm 80, opposite the elbow. Such leading arm 80 would generally be the arm of the golfer closest to the hole or target to which ball 44 is to be putted. For ease of description, the term "crook" in the arm is used, although such term generally represents that area of the leading arm 80 adjacent the juncture of the radius and humerus bones of the arm.

Putter 10 is manipulated to also cause an upper stabilization portion 78 of putter 10 to contact the outer portions 82 of the golfer's upper arm simultaneously with the medial stabilization portion being received in the crook of the golfer's same arm 80. Contact with the golfer's upper arm will generally be adjacent to the biceps, triceps, and brachialis muscles of the golfer's upper arm.

Figure 4:
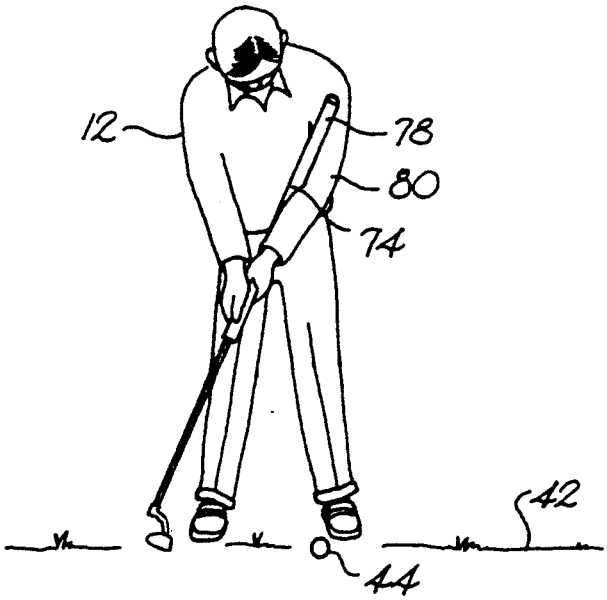
FIGS. 4 through 6 are sequential elevational views illustrating a golfer using a golf putter constructed in accordance with the present invention to perform a putt.
Figure 5:
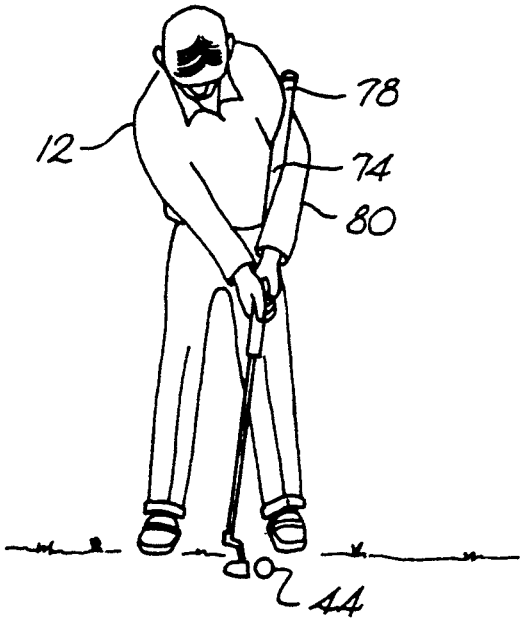
Figure 6:
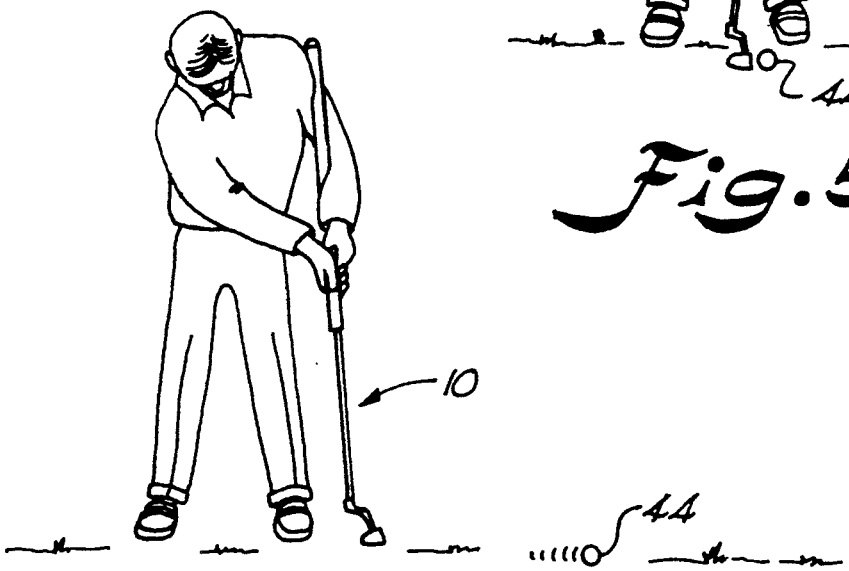

By cradling the midportion of putter 10 in the crook of the golfer's arm through receipt of the medial stabilization portion 74 and by contact of upper stabilization portion 78 with outer portions 82 of the golfer's upper arm, the putter is restrained from movement relative to the golfer's arms during putting motions, the sequence of a putt being shown in FIGS. 4 through 6. As shown in those figures, the upper end of putter 10 is securely held in the golfer's left arm, and the golfer's left wrist is substantially prevented from flexing or "breaking", and the golfer's left arm is substantially restrained from bending, during putting because of the restraining of putter 10 from movement by contact with the upper portion of the left arm and the left forearm.

Accordingly, the golfer is forced to move his arms during a putt, with the shoulders following the movement of the arms, which is the desired motion to be followed for putting recommended by many traditional teachers of the putting stroke, greatly lessening the chance of the golfer's wrists breaking and of the golfer's left arm bending during the putt. Because of the virtual elimination of breaking of the wrists and bending of the leading arm during putting, putting accuracy afforded to the golfer using putter 10 can be significantly improved.

By providing means and a method for both restraining the golfer's wrists and left arm from movement during putting and for allowing a substantially conventional putting grip to be used by the golfer, the putter and method of the present invention strives to allow the golfer to more closely approach and maintain a "triangle" between his shoulders and hands. Such a "triangle" configuration is formed with the shoulders acting as the base of the triangle and the hands acting as the point of the triangle opposite the base formed by the shoulders. The golfer's arms may be more or less straight depending on the individual golfer's preference, but once the relative angles between the arms and the shoulders are established, such angles will be encouraged to remain the same throughout the putting stroke. This maintaining of the triangle placement of the arms and hands during and throughout the putting swing is recommended by many traditional teachers of the putting stroke. The triangle configuration is also known as a solid "V", with the hands forming the vertex of the V and the arms forming the legs of the V. By locking the wrists of the golfer and by encouraging locking of the golfer's left arm during putting, the putter and method of the present invention aid the golfer during putting in keeping his arms and hands in the triangle, or V arrangement, and also, accordingly, in restraining relative movement between putter 10 and the golfer's wrists and arms.

From viewing the figures, the purpose of features such as the lateral offset d, offset angle Z, and putting face angle X becomes evident. By offsetting shaft 14 from the club head, in a direction away from the putting face, the golfer's hands are positioned directly over the ball, and a conventional putting configuration of the golfer's hands is allowed. Otherwise, without the offset, the golfer's hands would be out in front of the ball, and a conventional putting grip and stance would not be as practical. The angle X of putting face 24 allows putting face 24 to be substantially perpendicular to the ground when the putting face contacts the ball during a putt, thereby maximizing contact of putting face 24 with the ball and optimizing the transfer of energy from club head 18 to the ball. While using a putting face 24 that does not have angle X is possible, by not providing angle X to the putting face, the putting face would be at a slight angle from perpendicular (towards the ball) when contact with the ball is made, thereby directing undesirable downward forces to the ball.

The above description and the appended figures refer specifically to a putter 10 manufactured for use by a right-handed golfer. This assumption is made purely for convenience's sake, and would be obvious to one skilled in art to produce a mirror image putter designed for use by left-handed golfers. Such reversal of design, and other minor modifications to the described invention, is specifically intended to be embraced by the appended claims.

While a preferred embodiment of the invention has been described using specific terms, such description is for present illustrated purposes only, and it is to be understood that changes and variations to such embodiment, including but not limited to, the substitution of equivalent features or parts, an the reversal of various features thereof, may be practiced by those of ordinary skill in the art without departing from the spirit or scope of the following claims.

What is claimed is:

1. A golf club for use by a golfer to putt a golf ball, said golf club comprising:

an elongated shaft defining a first end, and a second end opposite said first end; said elongated shaft including a medial stabilization portion and an upper stabilization portion spaced from said medial stabilization portion;

a club head having a substantially planar putting face, a rear face opposite said putting face, an upper surface, and a lower surface opposite said upper surface; said club head defining a central axis approximately midway between said putting face and said rear face and extending substantially parallel to said putting face;

an offset connector connected to said club head and to said first end of said elongated shaft, said offset connector offsetting said first end of said elongated shaft from said central axis of said club head in a direction perpendicular to said central axis away from said putting face toward said rear face of said club head; and said first end of said elongated shaft being attached to said offset connector such that said elongated shaft extends at an angle with respect to said lower surface of said club head in a direction towards said planar putting face; said elongated shaft extending in a direction away from said rear face of said club head towards said planar putting face and projecting through a plane coplanar with said planar putting face of said club head, such that when using said golf club for putting, said medial stabilization portion of said elongated shaft is receivable in the crook of the golfer's leading arm, and the upper stabilization portion of said elongated club is contactable with the outer portion of an upper arm portion of the golfer's leading arm to portion of the golfer's upper arm, such that the club head of the golf putter contacts the golf ball in accomplishing a putt.

2. A golf club as defined in claim 1, wherein said offset connector includes an upstanding member attached to and projecting upwardly from said upper surface of said club head; and wherein said offset connector includes an angled bridging member defining a first end and a second end, said first end of said angled bridging member being connected to said upstanding member and said second end of said angled bridging member being connected to said first end of said elongated shaft.

3. A golf club as defined in claim 1, wherein said club head includes said rear face being substantially planar.

4. A golf club as defined in claim 1, wherein said putting face has a substantially planar surface portion extending towards said rear face at an acute angle with respect to said lower surface of said club head.

5. A golf club for use by a golfer to putt golf balls, said golf club comprising:

an elongated shaft defining a longitudinally extending shaft axis;

an elongated club head attached to said elongated shaft, a putting face a rear face opposite said putting face, an upper surface, a lower surface opposite said upper surface, a toe portion, and a heel portion opposite said toe portion; said putting face having a substantially planar surface portion extending at an acute angle with respect to said lower surface of said club head;

a hosel extending generally upwardly from said top surface of said elongated club head, said hosel having a first end connected to said top surface and a second end connected to said elongated shaft, said second end of said hosel being laterally offset from said first end of said hosel and being closer to said rear face of said club head than to said putting face of said club head such that said elongated shaft is offset laterally from said putting face in a direction substantially towards said rear face of said elongated club head; said second end of said hosel causing said elongated shaft to extend at an acute angle with respect to said lower surface of said club head towards said putting face, a portion of said elongated shaft extending above and over said putting face of said club head;

a longitudinally extending grip attached to said elongated shaft for gripping by the golfer during putting; and said elongated shaft defining a first end and a second end opposite said first end; said first end of said elongated shaft being attached to said second end of said hosel; said elongated shaft also including a medial stabilization portion for being received in the crook of the golfer's leading arm during putting and an upper stabilization portion for contacting the outer surfaces of an upper portion of the golfer's leading arm during putting, such that the golf club is stabilized with respect to said golfer's leading arm during putting, thereby minimizing relative motion between the golf club and the wrist of said golfer's leading arm during putting.

6. A golf club as defined in claim 5, wherein said hosel includes an upstanding member attached to and projecting upwardly from said upper surface of said club head; and wherein said hosel includes an angled bridging member defining a first end and a second end, said first end of said bridging member being connected to said upstanding member and said second end of said bridging member being connected to said first end of said elongated shaft.

7. A golf club as defined in claim 6, wherein said second end of said angled bridging member includes a socket for receiving said first end of said elongated shaft.

8. A golf club as defined in claim 5, wherein said elongated club head includes said rear face being substantially planar.

9. A golf club as defined in claim 5, wherein said longitudinally extending grip extends from substantially midway between said first and second end of said elongated shaft to said second end of said elongated shaft, said grip defining said medial and upper stabilization portions.

10. A golf club as defined in claim 5, wherein said elongated shaft includes at least one shaft extension member readily detachable from said elongated shaft.

11. A golf club as defined in claim 5, wherein said second end of said hosel includes a socket for receipt of said first end of said elongated shaft, said socket being angled with respect to said lower surface of said club head in a direction towards said putting face.

12. A golf club for use by a golfer to putt a golf ball, said golf club comprising:

an elongated shaft defining a first end, and a second end opposite said first end; a medial stabilization portion and an upper stabilization portion spaced from said medial stabilization portion;

a club head having a substantially planar putting face, a rear face opposite said putting face, an upper surface, and a lower surface opposite said upper surface; said club head defining a central axis approximately midway between said putting face and said rear face and extending substantially parallel to said putting face; said putting face portion extending towards said rear face at an acute angle with respect to said lower surface of said club head; and said first end of said elongated shaft being connected to said club head at a location laterally offset from said putting face in a direction towards said rear face of said club head; said first end of said elongated shaft being connected to said club head such that said elongated shaft extends at an acute angle with respect to said lower surface of said club head in a direction towards said putting face, a portion of said elongated shaft extending above and over said putting face of said club head, such that when using said golf club for putting, said medial stabilization portion of said elongated shaft is received in the crook of the golfer's leading arm, and said upper stabilization portion contacts the outer portion of an upper portion of the golfer's leading arm to restrain movement of the golf club relative to the wrist of said golfer's leading arm during putting.

13. A golf club as defined in claim 12, further comprising a connector for connecting said first end of said elongated shaft to said club head.

14. A golf club as defined in claim 13, wherein said connector includes an offset portion connected to said club head and to said first end of said elongated shaft, said offset portion offsetting said first end of said elongated shaft a predetermined distance from said central axis of said club head in a direction perpendicular to said central axis away from said putting face and towards said rear face of said club head.

15. A golf club as defined in claim 13, wherein said connector causes said elongated shaft to extend upwardly from said club head at an acute angle with respect to said lower surface of said club head and in a direction towards said heel of said club head.

16. A method of putting a golf ball by a golfer, comprising:

providing a golf club having a club head with a putting face for positioning adjacent the ground and an elongated shaft connected to the club head, the elongated shaft defining a medial stabilization portion and an upper stabilization portion;

simultaneously positioning the golf putter such that the medial stabilization portion is received in the crook of the golfer's leading arm, the upper stabilization portion extends above and over the putting face of the club head and contacts the outer portion of the golfer's upper arm, and the putting surface of the club head is substantially perpendicular to the ground adjacent the ball to be putted;

gripping of the elongated shaft below the medial stabilization portion of the elongated shaft with the golfer's hands; and moving of the golfer's arms while retaining the medial stabilization portion in the crook of the golfer's leading arm and while retaining the upper stabilization portion against the outer portion of the golfer's upper arm, such that the club head of the golf putter contacts the golf ball in accomplishing a putt.

* * * * *